US005403509A

United States Patent [19]

Pujol et al.

[11] Patent Number: 5,403,509

[45] Date of Patent: Apr. 4, 1995

[54] DETERGENT COMPOSITION COMPRISING A MONO-, DI- AND TRI-ESTER MIXTURE AND METHOD OF MANUFACTURING SAME

[75] Inventors: Enrique Pujol; Francisco Pujadas; Antonio Prat; Kazuhiko Okabe, all of Barcelona, Spain

[73] Assignee: Kao Corporation, S.A., Barcelona, Spain

[21] Appl. No.: 93,621

[22] Filed: Jul. 20, 1993

Related U.S. Application Data

[63] Continuation-in-part of Ser. No. 979,052, Nov. 19, 1992, abandoned.

[30] Foreign Application Priority Data

Jul. 20, 1992 [EP] European Pat. Off. ..... 92500092

[51] Int. Cl.[6] ..... C11D 1/825; C11D 1/722; C11D 11/04

[52] U.S. Cl. ..... 252/174.22; 252/174.21; 252/DIG. 1

[58] Field of Search ..... 252/174.22, 174.21, 252/DIG. 1

[56] References Cited

U.S. PATENT DOCUMENTS

| | | | |
|---|---|---|---|
| 2,307,047 | 1/1943 | Katzmann et al. | 252/174.21 |
| 2,828,265 | 3/1958 | Van Strien | 252/174.21 |
| 3,031,510 | 4/1962 | Crecelius | 252/174.21 |
| 3,110,736 | 11/1963 | De Groote et al. | 252/174.21 |
| 3,451,936 | 6/1969 | Nobile et al. | 252/174.21 |
| 3,776,857 | 12/1973 | Lindner | 252/308 |
| 4,247,425 | 1/1981 | Egan et al. | 252/548 |
| 4,256,611 | 3/1981 | Egan et al. | 252/548 |
| 4,263,284 | 4/1981 | Schreuder | 424/180 |
| 4,614,622 | 9/1986 | Hueltinger et al. | 554/227 |
| 4,797,222 | 1/1989 | Hoefer et al. | 252/174.21 |
| 4,897,214 | 1/1990 | Gazzani | 252/170 |
| 4,902,439 | 2/1990 | Abel et al. | 252/174.25 |
| 4,908,150 | 3/1990 | Hessel et al. | 252/174.12 |

FOREIGN PATENT DOCUMENTS

| | | |
|---|---|---|
| 0007120 | 1/1980 | European Pat. Off. . |
| 0080749 | 6/1983 | European Pat. Off. . |
| 2390498 | 12/1978 | France . |
| 2457927 | 6/1975 | Germany . |
| 51-44641 | 4/1976 | Japan . |
| 52-22007 | 2/1977 | Japan . |
| 55-86894 | 7/1980 | Japan . |
| 55-133495 | 10/1980 | Japan . |
| 56-36599 | 4/1981 | Japan . |
| 83037356 | 8/1983 | Japan . |
| 1453385 | 10/1976 | United Kingdom . |
| 2197338 | 5/1988 | United Kingdom . |
| 9200945 | 1/1992 | WIPO . |

OTHER PUBLICATIONS

Chemical Abstracts (1984), vol. 100, No. 24 Abstract No. 194041r, for JP 59-1600, Jan. 6, 1984.

Patent Abstracts of Japan, (1989) vol. 013, No. 388 (C630), for JP 1135714, May 29, 1989.

Database WPI, Derwent Pub. Ltd. Abstract, class A97, AN 80-85324C, for JP 55133495, Oct. 18, 1980.

*Primary Examiner*—Paul Lieberman
*Assistant Examiner*—A. Hertzog
*Attorney, Agent, or Firm*—Birch, Stewart, Kolasch & Birch

[57] ABSTRACT

A detergent composition comprising a mixture of mono-, di- and tri-ester nonionic compounds represented by formula (I) and a nonionic compound represented by formula (II), wherein the weight ratio of said mono-, di and tri-ester nonionic compounds is 46-90-/9-30/1-15,

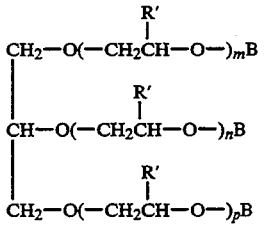

(I)

(Abstract continued on next page.)

-continued

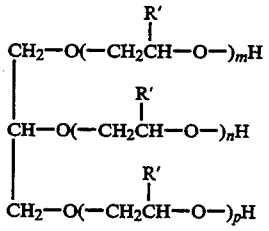

(II)

wherein B represents a hydrogen atom or a

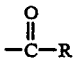

group and R represents an alkyl or alkenyl group having 6 to 22 carbon atoms, R′ represents H or a $CH_3$ group, and each of n, m and p independently represents an integer from 0 to 40 and $m+n+p=2-100$; said detergent composition exhibiting outstanding biodegradability, non-toxicity, non-irritancy, foam stability and better dye inhibition transfer, while maintaining and even improving detergency.

6 Claims, No Drawings

DETERGENT COMPOSITION COMPRISING A MONO-, DI- AND TRI-ESTER MIXTURE AND METHOD OF MANUFACTURING SAME

This application is a continuation-in-part of Ser. No. 07/979,052, filed Nov. 19, 1992, now abandoned.

FIELD OF THE INVENTION

The present invention relates to novel liquid detergent compositions which are biodegradable, non-toxic, and non-irritating detergency, foam stability and colour protection in case of heavy and light duty detergent. These detergent compositions are particularly useful in formulating shampoos, body shampoos, washing up, all purpose cleaners, and heavy and light duty detergents.

In fact, the present invention relates to cleaning formulations comprising a specific nonionic mixture.

In addition, the present invention relates to a method for preparing the above mentioned nonionic mixture.

DESCRIPTION OF PRIOR ART

Most detergent compositions use a combination of anionic, amphoteric and/or nonionic surfactants, in order to obtain a final product having better properties in terms of irritation, detergency and foam profile.

One problem in the field of chemicals is the question of ecotoxicity and how to get good performance without serious interaction with the surface of fabrics or skin.

The nonionic compounds conventionally employed in employed in the detergent compositions are ethoxylated nonylphenols, $C_{12-18}$ alcohols ethoxylated with approximately 12 moles of ethylene oxides, and lately, $C_{12-15}$ alcohols ethoxylated with 2 to 9 moles of ethylene oxides and EO/OP derivatives.

For example

Japanese Patent Laid-Open No. 55-86894 discloses the use of a secondary $C_{6-14}$ alcohol ethoxylated with 4–15 moles of ethylene oxides on average.

Japanese Patent Laid-Open No. 52-22007, and Japanese Patent Publication No. 83037356 disclose the use of an ethoxylated middle alcohol of the formula $R_1O(C_2H_4O)nH$, wherein $R_1$ is a straight or branched chain alkyl and n is 1–12 on average in detergent compositions.

European Patent No. 80749 discloses the use of ethoxylated alkyl phenols in detergent compositions.

U.S. Pat. No. 4,908,150 discloses the use of polyethylene glycol ether of a glycerol ester compositions.

Japanese Patent Laid-Open No. 55-133495 discloses the use of a polyoxyethylene hardened castor oil or fatty acid ester, thereof, polyoxyethylene glyceryl ether fatty acid ester, polyoxyethylene trimethylol propane fatty acid ester and polyoxyethylene alkylether diester of N-lauroylglutamic acid in detergent compositions.

However, use of such nonionic compounds deteriorates the detergency ability of detergent formulations, and in the case of heavy and light duty liquid detergents tends to cause dye transfer, especially upon repeated laundering. In addition to the above mentioned points, current nonionic compounds cause skin and eye irritation, and the toxicity to fish daphnia inmobilization and algae are unacceptable under the present environmental requirements.

Other patents describe the use of specific nonionic compounds, different from the usual ones, in particular applications and/or conditions.

U.S. Pat. No. 4,247,425 discloses the use of alkoxylated partial glycerol esters of a detergent grade fatty acid in light duty detergent compositions.

EP Patent 0007120 discloses an emulsifying system, to be used in a handwashing composition, mainly consisting of mono- and diglycerides of higher natural fatty acids and ethoxylated glycerine esterified by fatty acids.

U.S. Pat. No. 4,897,214, discloses the use of monoesters of fatty acids with polyoxyethylene hexitan derivatives in skin cleaning preparations.

FIELD OF THE INVENTION

WO Patent 92/00945 discloses the use of octadienyl glycerin ethers with polyoxyethylene.

UK Patent 2197338 discloses the use of polyoxyalkylene alkyl- or alkenyl ethers and polyoxyalkylene glycerol fatty acid esters in detergent compositions.

None of disclosures mentioned above teaches the mixture of nonionic compounds according to the present invention.

The present inventors have carried out research to develop a detergent composition that exhibits outstanding biodegradability, non-toxicity, non-irritant foam stability and better dye inhibition transfer, while maintaining detergency, and even having improved detergency.

It was unexpectedly found that the above mentioned requirements can be satisfied when the specified mixture of nonionic compounds of the present invention is incorporated into a detergent composition.

This finding has led to the present invention.

SUMMARY OF THE INVENTION

Accordingly, the present invention relates to a detergent compositions comprising a mixture of mono-, di- and tri-ester nonionic compounds represented by formula (I), wherein the weight ratio of the mono-, di- and tri-ester nonionic compounds is 46–90/9–30/1–15

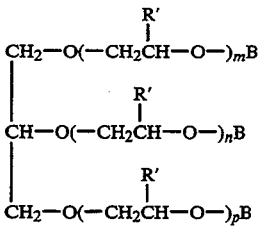

(II)

wherein B represents a hydrogen atom or a

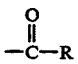

group, R represents an alkyl or alkenyl group having 6 to 22 carbon atoms, and at least one B is an ester group;

p, n and m have a value between 0 and 40 and $(p+n+m)=2-100$ preferably 9–19; and R′ represents H or $CH_3$ group; and a nonionic compound represented by formula (II)

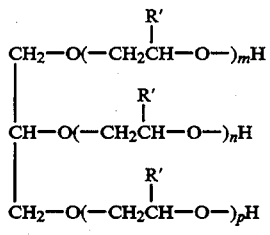

(II)

wherein p, n and m have a value between 0 and 40 and $(p+n+m)=2-100$ preferably 9–19; and R′ represents H or a $CH_3$ group.

The high content of ethoxylated monoester represented by formula (I) and the ratio of compounds represented by formula (I) and the compound represented by formula (II) are the key parameters in obtaining the above mentioned properties.

The weight ratio of the nonionic compounds represented by formula (I) to the nonionic compound represented by formula (II) in the detergent composition may have a value between 3 to 0.33, preferably 1.3 to 0.75.

A mixture of the nonionic compounds represented by formula (I) and the nonionic compound represented by formula (II) in can be obtained by conventional methods.

For example, the mixture can be obtained by the following reaction processes.

(A) The interesterification reaction between triglyceride and glycerine, in a molar ratio of 0.1–10/1, preferably 0.15–3.5 (in the presence of an alkaline catalyst), and the reaction with a $C_{2-3}$ alkylene oxide, or viceversa will lead to a mixture of mono-, di- and triglyceride nonionic compounds represented by formula (I) and the nonionic compound represented by formula (II), having the desired ratio of compounds represented by formula (I) to the compound represented by formula (II), due to migration and an exchange phenomena, with an HLB higher than 2.

(B) The reaction of glycerine with a $C_{2-3}$ alkylene oxide, in the presence of alkaline catalysts, and the later reaction with fatty acid in a molar ratio of 0.1–10/1, preferably 0,7–3.5/1 in the presence of an acidic or alkaline catalyst will lead to a mixture of mono- di- and triglyceride nonionic compounds represented by formula (I) and the nonionic compound represented by formula (II) due to a migration and exchange phenomena, with an HLB higher than 2.

Triglycerides that can be used in process (A) include natural fat and oil, as well as synthetic triglyceride.

The fat and oil include vegetable oil, such as coconut oil, palm oil, and soybean oil; animal fat and oil, such as beef tallow, and bone oil; aquatic animal fat and oil; hardened oil and semihardened oil thereof.

In the present invention the mixture of nonionic compounds represented by formula (I) and the nonionic compound represented by formula (II) can be incorporated in an amount of from 0.2% to 40%, preferably from 3% to 20% by weight based on the total weight of the detergent composition.

The reason why the detergent composition of the present invention exhibits outstanding biodegradability, non-toxicity and non-irritancy, without deterioration of its detergeny is uncertain, but it appears that good performance of the present composition results partially from the existence of fatty acid groups that facilitates biodegradability and very low skin irritation, oral toxicity, fish toxicity, algae and daphnia inmobilization, as compared with conventional nonionic compound.

Furthermore incorporation of the mixture described herein considerably improves the foam profile, anti dye transfer and perfume solubilization properties of a detergent composition, when compared with conventional formulations, a high EO monoglyceride ratio and the synergistic effect between the compounds represented by formulae (I) and (II).

Other surface active agents such as anionic, other nonionic, and amphoteric agents and other additive useful in the practice of this invention may be used depending on the kind of final product to be formulated. These other surface active agents and additives so they are standard items of commerce so they will be not further comments upon herein.

EXAMPLE

The present invention is described in detail by way of the following examples. The present invention, however, is not limited to these examples.

REFERENTIAL EXAMPLE 1.

The mixture of nonionic compounds represented by formula (I) and the nonionic compound represented by formula (II) is obtained, for instance by the following process:

Step (c).

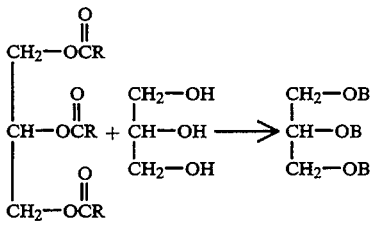

Step (d).

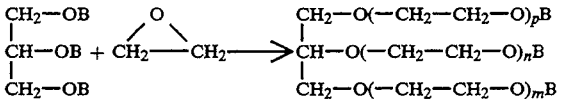

wherein B represents a hydrogen atom or a

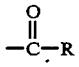

and group; $p+m+n=15$;

represents a coco alkyl chain; and the weight ratio of nonionic compounds represented by formula (I) to the nonionic compound represented by formula (II) is 1.

500 g (0.76 moles) of coco TRG, 210.7 g (2.29 moles) of glycerine 99% and 1.2 g of KOH 85% as a catalyst are placed in a 3 kg flask properly equipped. The system is purged several times with $N_2$, vacuum stripped until 110° C., and heated to 140° C. When the temperature reaches 140° C., the reactor is pressurized to 2–3 kg/cm$^2$, and ethylene oxide is added until a total of 2013 gr (45.7 moles).

After the final charge of ethylene oxide, the reaction mixture is allowed to react for about ½ hour; the reaction mixture is then cooled and discharged from reactor. A mixture of nonionic compounds represented by formula (I) and the nonionic compound represented by formula (II) is obtained.

REFERENTIAL EXAMPLE 2.

The mixture of nonionic compounds represented by formula (I) and the nonionic compound represented by formula (II) is obtained, for instance by the following process:

Step (e).

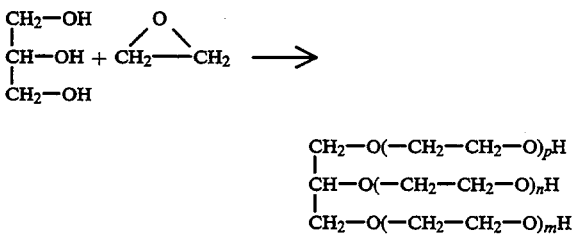

Step (f).

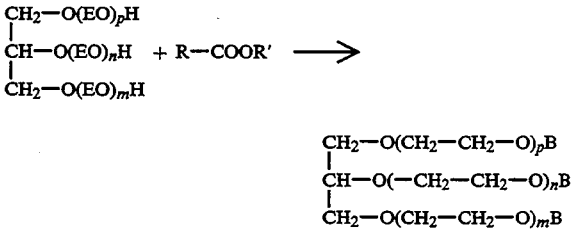

wherein B represents a hydrogen atom or a

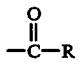

group; p+m+n=10;

R′ represents a $CH_3$ group;

R represents a tallow alkyl chain; and the weight ratio of compounds represented by formula (I) to the compound represented by formula (II) is 1.3.

14.3 g (0.1554 moles) of glycerine 99% and 1.2 g of KOH 85% as a catalyst are placed in a 250 gr flask properly equipped. The system is purged several times with $N_2$, vacuum stripped until 110° C., and heated to 140° C. When the temperature reaches 140° C., the reactor is pressurized to 2–3 kg/cm$^2$ and ethylene oxide is added until a total of 67.9 gr (1.54 moles). After the final charge of ethylene oxide, the reaction mixture is allowed to react for about ½ hour; 52.3 gr (0.15 mol) of a methyl ester of fatty acid derived from tallow is added and mixed for 45 minutes. Finally, the product is cooled and discharged from reactor. Thus a mixture of nonionic compounds represented by formula (I) and the nonionic compound represented by formula (II) is obtained.

EXAMPLE 1. HDPD

| Raw materials | COMPOSITION 1 | 2 | 3 | 4 | 5 | 6 |
|---|---|---|---|---|---|---|
| Na dodecyl benzene sulphonate | 10 | 10 | 10 | 10 | 10 | 10 |
| Ethoxylated (7) $C_{13-15}$ alcohol | 9 | — | 6 | — | 9 | — |
| Nonionic mixture of present invention (from referential example 2) | — | 9 | — | 6 | — | 9 |

-continued

EXAMPLE 1. HDPD

| Raw materials | COMPOSITION 1 | 2 | 3 | 4 | 5 | 6 |
|---|---|---|---|---|---|---|
| Coco fatty acid | — | — | 2 | 2 | — | — |
| Silicone | 0.2 | 0.2 | 0.1 | 0.1 | 0.2 | 0.2 |
| Zeolite | 35 | 35 | — | — | 35 | 35 |
| STPP | — | — | 35 | 35 | — | — |
| Polycarboxilated | 5 | 5 | 5 | 5 | 5 | 5 |
| CMC | 1.5 | 1.5 | 1.5 | 1.5 | 1.5 | 1.5 |
| Perborate mono hydrate | 15 | 15 | 13 | 13 | 15 | 15 |
| Na Carbonate | 12 | 12 | 15 | 15 | 12 | 12 |
| Na Silicate | 2 | 2 | 2 | 2 | 2 | 2 |
| PVP | — | — | — | — | 0.8 | 0.6 |
| Enzyme | 0.7 | 0.7 | 0.7 | 0.7 | 0.7 | 0.7 |
| TAED | 4 | 4 | 4 | 4 | 4 | 4 |
| Sodium sulphate | B. | B. | B. | B. | B. | B. |
| Perfume | 1 | 1 | 1 | 1 | 1 | 1 |

Note:
B means balance.

Note: B means balance.

Detergency evaluation test:

Washing machine:

Temperature: 30° C. and 60° C.

Dosage: 6 gr/l.

Water hardness: 20° HF and 40° HF.

Washing load: 2 kg of non-soiled cotton-polyester cloth and EMPA 101, 104, 117+particulated soil.

No pre-washing program.

Detergent ability was evaluated for the detergent compositions appearing in Table 1.

With all variables taken into consideration, that is, temperature, water hardness and soil type, the nonionic mixture described herein demonstrate in the worst of cases, equivalent efficiency in terms of detergency.

However, on the other hand, compositions containing the nonionic mixture of the present invention provide a more superior colour care than the conventional ethoxylated alcohol.

The following tests have been conducted at 30° C.

1.- Using Reactive dyestuff.

After 15 washings, differences appeared in terms of colour transfer.

Dye transfer was evaluated measuring delta E values $(L^2+a^2+b^2)^{½}$by Hunter-Lab. The resulting discolouration of fabrics is shown in the table below:

TABLE 1

| Compositions | Blue | Green | Red |
|---|---|---|---|
| 1 | 8.0 | 14.0 | 6.0 |
| 2 | 5.7 | 10.3 | 5.0 |
| 3 | 6.0 | 8.0 | 4.5 |
| 4 | 5.0 | 6.5 | 4.0 |
| 5 | 1.3 | 0.9 | 0.5 |
| 6 | 1.2 | 1.0 | 0.5 |

The lower delta E, the better the composition is able to prevent dye transfer. Therefore it can be concluded from the above results that the nonionic mixture according to the present invention performs better than alcohol ethoxylated in preventing dye transfer and it is possible to save on the amount of polyvinylpirrolidone used (a typical dye-transfer inhibitor). The specific amount to be saved will depend on the effect of other components, or, in other words, on formulation design. It appears to the inventors that a synergistic effect exists between the nonionic mixture of present invention and PVP.

2.- Using Direct dyestuff.

References:
Yellow: Solar Yellow 3LG 160%
Blue: Solar Blue 2GLN 350%

| Formulations: | Blue | Green | Yellow |
|---|---|---|---|
| Solar Blue 2GLN 350% | 1% | 1% | — |
| Solar Yellow 3LG 160% | — | 1% | 1% |
| $SO_4Na_2$ | 20 g/l | 20 g/l | 20 g/l |
| Sandofix R | 3% | 3% | 3% |

After 3 washings, differences appeared in terms of colour transfer.

Dye transfer was evaluated measuring delta E values $(L^2+a^2+b^2)^{\frac{1}{2}}$by Hunter-Lab. The resulting discoloration of fabrics is shown in the table below:

TABLE 2

| Compositions | Blue | Green | Yellow |
|---|---|---|---|
| 1 | 2.0 | 2.5 | 4.0 |
| 2 | 1.3 | 1.7 | 3.0 |
| 3 | 1.6 | 8.0 | 3.2 |
| 4 | 0.9 | 6.5 | 2.0 |
| 5 | 1.3 | 0.9 | 0.7 |
| 6 | 1.2 | 1.0 | 0.7 |

The results of tests 1 and 2, were corroborated by a 5 person panel, who evaluated the results according to a scale.

EXAMPLE 2.
HDL

| Raw materials | COMPOSITIONS 1 | 2 | 3 | 4 |
|---|---|---|---|---|
| Na lauryl sulphate | — | — | 4 | 4 |
| Na dodecyl benzene sulphonate | 10 | 10 | 5 | 5 |
| Ethoxylated (7) $C_{13-15}$ alcohol. | — | 5 | — | 15 |
| Nonionic of present invention. (from referential example 2) | 5 | — | 15 | — |
| Potasium coconut soap | 5 | 5 | 10 | 10 |
| Ethanol | — | — | 3 | 3 |
| Propylenglycol | 7 | 7 | 7 | 7 |
| Perfum | 1 | 1 | 1 | 1 |
| Enzyme | 0.7 | 0.7 | 0.5 | 0.5 |
| Na formiate | 1 | 1 | 1 | 1 |
| Na phosphonate | 0.8 | 0.8 | 0.8 | 0.8 |
| TEA 85% | Req. | Req. | Req. | Req. |
| NAOH 50% | Req. | Req. | Req. | Req. |
| $Cl_2Ca$ 1% | 2 | 2 | 2 | 2 |
| Water | B. | B. | B. | B. |

Note:
B means balance.
Req. means required amount.

Following the same test conditions explained above for HDPD, (adapting the dosage according to the composition) the following results were obtained:

Sufficient detergency in all cases.

Colour appearance results are shown in Table 3.

TABLE 3

| Compositions | Blue | Green | Red |
|---|---|---|---|
| 1 | 0.9 | 4.0 | 3.2 |
| 2 | 1.5 | 5.0 | 3.8 |
| 3 | 1.6 | 5.1 | 3.8 |
| 4 | 3.0 | 6.0 | 4.5 |

Compositions containing the nonionic mixture of the present invention better prevent colour transfer, even in HDL where the pH is neutral and no optical brighters are used. (Note that HDL was used as colour saving detergents before the use of the new segment of colour saving H.D.P.D.).

EXAMPLE 3.
WASHING UP.

| Raw materials | COMPOSITIONS 1 | 2 | 3 | 4 |
|---|---|---|---|---|
| Na lauryl ether sulphate | 10 | 10 | 7 | 7 |
| Na Alfa-olephine sulphonate | — | — | 4 | 4 |
| Alkyl amido propyl betaine | 5.3 | 4.5 | 5.7 | 2.5 |
| Ethoxylated (7) $C_{13-15}$ alcohol | 13 | — | — | — |
| Nonionic of present invention. (from referential example 1) | — | 7 | — | 7 |
| Coconut diethanol amide | 5 | — | — | — |
| Amine oxide | — | — | 3.3 | — |
| Perfume | 1 | 1 | 1 | 1 |
| Water | bal. | bal. | bal. | bal. |

TABLE 4

| Composition | 1 | 2 | 3 | 4 |
|---|---|---|---|---|
| No of dishes: | 28 | 33 | 29 | 34 |
| Fat dispersion (*) | R | QG | G | VG |

(*) Key: R regular; QG quite good; G good enough; VG Very good.

Compositions containing Levenol show good detergency and fat dispersion, by permitting a substitution of nitrogen derivatives (alkanol amide and amine oxide), thereby avoiding the use of products containing nitrosamines. Another advantage of the composition is that due to the reduction in irritation of the composition when combined with an anionic surfactant, it is possible to substitute betaine. The mixture of nonionic compounds of the present invention gives a creamy foam compared to other compositions.

In order to evaluate the effect on the skin of the mixture of nonionic compounds of the present invention, a primary skin irritation test was conducted:

| | COMPOSITION | | IRRITATION INDEX |
|---|---|---|---|
| | EXAMPLE 4. | | |
| 1. | Sodium lauryl sulphate | 6.25% | 1.88 |
| 2. | Sodium lauryl sulphate | 4.25% | |
| | + | | |
| | Nonionic (1) | 2.00% | 1.00 |
| 3. | Sodium lauryl sulphate | 4.25% | 1.38 |
| | EXAMPLE 5. | | |
| 1. | Sodium lauryl sulphate | 4.25% | |
| | Coco imidazoline betaine | 2.00% | 1.08 |
| 2. | Sodium lauryl sulphate | 4.25% | |
| | + | | |
| | Alkylamide propyl betaine | 2.00% | 0.96 |
| 3. | Sodium lauryl sulphate | 4.25% | |
| | + | | |
| | Nonionic (1) | 2.00% | 1.00 |

(1) Represents the nonionic mixture of the present invention from referential example 2.

From the comparison of the above compositions, the mild effect of the nonionic of the present invention can be inferred.

The invention claimed is:

1. A detergent composition comprising a mixture of mono-, di- and tri-ester nonionic compounds represented by formula (I) and a nonionic compound represented by formula (II), wherein the weight ratio of said mono-, di- and tri-ester nonionic compounds is 46–90/9–30/1–15,

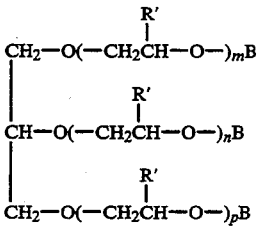

(I)

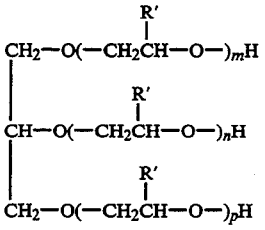

(II)

wherein B represents H or

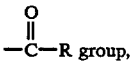

R represents an alkyl or alkenyl group having 6 to 22 carbon atoms, and at least one B is an ester group; R′ represents H or a $CH_3$ group; and each of n, m and p independently represents an integer from 0 to 40 and m+n+p=2–100.

2. The detergent composition according to claim 1, wherein the weight ratio of said nonionic compounds represented by formula (I) to said nonionic compound represented by formula (II) is from 3 to 0.33.

3. The detergent composition according to claim 1, wherein m+n+p=9–19.

4. The detergent composition according to claim 1, wherein the weight ratio of said nonionic compounds represented by formula (I) to said nonionic compound represented by formula (II) is from 1.3 to 0.75.

5. A method for the preparation of a detergent composition comprising a mixture of mono-, di- and tri-ester nonionic compounds represented by formula (I) and a nonionic compound represented by formula (II), wherein the weight ratio of said mono-, di- and triester nonionic compounds is 46–90/9–30/1–15,

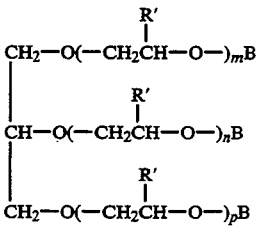

(I)

-continued

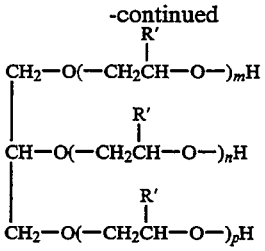

(II)

wherein B represents H or a,

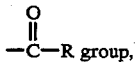

R represents an alkyl or alkenyl group having 6 to 22 carbon atoms, and at least one B is an ester group; R′ represents H or a $CH_3$ group; and each of n, m and p independently represents an integer from 0 to 40 and m+n+p=2–100, comprising:

a) subjecting a mixture of triglyceride and glycerine having a molar ratio of 0.1–10/1 to a inter-esterification reaction, and b) subjecting said reaction mixture obtained in step (a) to alkoxylation using an alkaline oxide having 2 to 3 carbon atoms in the presence of an alkaline catalyst to produce said nonionic compounds represented by formula (1) and said nonionic compound represented by formula (II).

6. A method for the preparation of a detergent composition comprising a mixture of mono-, di- and tri-ester nonionic compounds represented by formula (I) and a nonionic compound represented by formula (II), wherein the weight ratio of said mono-, di- and tri-ester nonionic compounds is 46–90/9–30/1–15

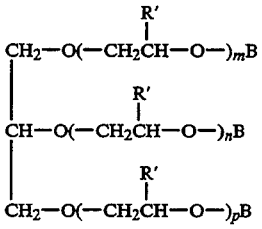

(I)

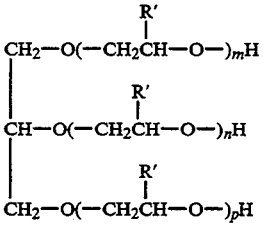

(II)

wherein B represents H or a

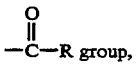

R represents an alkyl or alkenyl group having 6 to 22 carbon atoms, and at least one B is an ester group; R′ represents H or a $CH_3$ group; and each of n, m and p independently represents an integer from 0 to 40 and m+n+p=2–100; comprising:

c) reacting a mixture of glycerine and a $C_{2-3}$ alkaline oxide in the presence of an alkaline catalyst, and d) reacting said reaction mixture obtained in step (c) with a methyl ester of fatty acid or a fatty acid in a molar ratio of 0.1–10/1.

* * * * *